US011073269B1

(12) United States Patent
Lax et al.

(10) Patent No.: US 11,073,269 B1
(45) **Date of Patent: *Jul. 27, 2021**

(54) LED LIGHT FIXTURE FOR USE IN PUBLIC TRANSPORTATION FACILITIES

(71) Applicant: Autronic Plastics, Inc., Central Islip, NY (US)

(72) Inventors: Daniel A. Lax, Roslyn, NY (US); Agjah I. Libohova, East Setauket, NY (US); Roy Jacob, Wantagh, NY (US)

(73) Assignee: Autronic Plastics, Inc., Central Islip, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/230,682

(22) Filed: Apr. 14, 2021

Related U.S. Application Data

(60) Continuation of application No. 17/153,523, filed on Jan. 20, 2021, now Pat. No. 11,035,561, which is a (Continued)

(51) Int. Cl.
*F21V 23/02* (2006.01)
*F21V 23/04* (2006.01)

(Continued)

(52) U.S. Cl.
CPC ..... *F21V 23/02* (2013.01); *F21S 9/022* (2013.01); *F21V 23/00* (2013.01); *F21V 23/04* (2013.01);

(Continued)

(58) Field of Classification Search
CPC ..... F21V 23/02; F21V 23/00; F21V 23/04; F21V 23/0435; F21S 9/022; F21Y 2115/10; F21W 2131/101; F21W 2131/40
See application file for complete search history.

(56) References Cited

U.S. PATENT DOCUMENTS 5,568,129 A 10/1996 Sisselman et al.
6,538,568 B2 * 3/2003 Conley, III ..... H05B 47/19 340/540

(Continued)

OTHER PUBLICATIONS

Petition for Inter Partes Review of U.S. Pat. No. 9,909,748, IPR2020-01023, filed Jun. 3, 2020, Memorandum, Treatment of Statements of the Applicant in the Challenged Patent in Inter Partes Reviews Under Section 311.

(Continued)

*Primary Examiner* — Bao Q Truong
(74) *Attorney, Agent, or Firm* — Zollinger & Burleson, Ltd.

(57) ABSTRACT

LED lighting systems, mounting configurations, and light fixtures are disclosed for original and retrofit configurations. Some configurations mount the light fixture with a mounting bracket that allows for the removal and replacement of the light fixture in about the same time as a traditional light bulb change. Some configurations provide for fuse removal and replacement without the need to dismount the light fixture from its mounting bracket or without the need to open the housing of the light fixture to access the fuses. Some configurations use a battery backup system and self-check methods with LED light fixtures configured for public transportation applications.

29 Claims, 10 Drawing Sheets

Related U.S. Application Data continuation of application No. 15/886,406, filed on Feb. 1, 2018, now Pat. No. 10,941,929, which is a division of application No. 14/703,705, filed on May 4, 2015, now Pat. No. 9,909,748.

(60) Provisional application No. 61/988,032, filed on May 2, 2014.

(51) Int. Cl.

| | |
|---|---|
| ***F21S 9/02*** | (2006.01) |
| ***F21V 23/00*** | (2015.01) |
| *F21W 131/40* | (2006.01) |
| *F21Y 115/10* | (2016.01) |
| *F21W 131/101* | (2006.01) |

(52) U.S. Cl.

CPC .... *F21V 23/0435* (2013.01); *F21W 2131/101* (2013.01); *F21W 2131/40* (2013.01); *F21Y 2115/10* (2016.08)

(56) References Cited

U.S. PATENT DOCUMENTS

| | | | | |
|---|---|---|---|---|
| 7,178,941 | B2 * | 2/2007 | Roberge | F21K 9/00 362/225 |
| 7,227,278 | B2 * | 6/2007 | Realmuto | H02J 1/10 307/44 |
| 8,299,712 | B2 * | 10/2012 | Smith, III | F21S 10/06 315/86 |
| 8,398,276 | B2 | 3/2013 | Pearson et al. | |
| 9,909,748 | B2 * | 3/2018 | Lax | F21S 9/022 |
| 10,190,760 | B2 * | 1/2019 | Lax | F21V 23/00 |
| 10,941,929 | B2 * | 3/2021 | Lax | F21V 23/00 |

OTHER PUBLICATIONS

Petition for Inter Partes Review of U.S. Pat. No. 9,909,748, IPR2020-01023, filed Jun. 3, 2020, Patent Owner Preliminary Response.
Petition for Inter Partes Review of U.S. Pat. No. 9,909,748, IPR2020-01023, filed Jun. 3, 2020, Declaration of Dr. Robert F. Karlicek in Support of Patent Owner's Preliminary Response.
Petition for Inter Partes Review of U.S. Pat. No. 9,909,748, IPR2020-01023, filed Jun. 3, 2020, Karlicek Full C.V.
Petition for Inter Partes Review of U.S. Pat. No. 9,909,748, IPR2020-01023, filed Jun. 3, 2020, Karlicek Declaration, Exhibit 2017.
Petition for Inter Partes Review of U.S. Pat. No. 9,909,748, IPR2020-01023, filed Jun. 3, 2020, Karlicek Declaration, Exhibit 2015.
Petition for Inter Partes Review of U.S. Pat. No. 9,909,748, IPR2020-01023, filed Jun. 3, 2020, Karlicek Declaration, Exhibit 2018.
Petition for Inter Partes Review of U.S. Pat. No. 9,909,748, IPR2020-01023, filed Jun. 3, 2020, Karlicek Declaration, Exhibit 2016.
Petition for Inter Partes Review of U.S. Pat. No. 9,909,748, IPR2020-01023, filed Jun. 3, 2020, Reply to Patent Owner's Preliminary Response.
Petition for Inter Partes Review of U.S. Pat. No. 9,909,748, IPR2020-01023, filed Jun. 3, 2020, Patent Owner Sur—Reply in Support of Patent Owner Preliminary Response.
Petition for Inter Partes Review of U.S. Pat. No. 9,909,748, IPR2020-01023, filed Jun. 3, 2020, Decision Granting Instituion of Inter Partes Review.
Petition for Inter Partes Review of U.S. Pat. No. 9,909,748, IPR2020-01023, filed Jun. 3, 2020, Scheduling Order.
Petition for Inter Partes Review of U.S. Pat. No. 9,909,748, IPR2020-01023, filed Jun. 3, 2020, Patent Owner's Objections under 37 CFR 42.64 to Petitioner's Evidence.
Petition for Inter Partes Review of U.S. Pat. No. 9,909,748, IPR2020-01023, filed Jun. 3, 2020, Patent Owner's Request for Rehearing.
Petition for Inter Partes Review of U.S. Pat. No. 9,909,748, IPR2020-01023, filed Jun. 3, 2020, Petitioner's Response to Patent Owner's Request for Rehearing.
Petition for Inter Partes Review of U.S. Pat. No. 9,909,748, IPR2020-01023, filed Jun. 3, 2020, Petitioner's Notice of Service of Supplemental Evidence.
Petition for Inter Partes Review of U.S. Pat. No. 9,909,748, IPR2020-01023, filed Jun. 3, 2020, Decision Denying Patent Owner's Request for Rehearing on Institution, dated Feb. 3, 2021.
Petition for Inter Partes Review of U.S. Pat. No. 9,909,748, IPR2020-01023, filed Jun. 3, 2020, Notice of Joint Stipulation to Modify Dates 1-3, Feb. 24, 2021.
Petition for Inter Partes Review of U.S. Pat. No. 10,190,760, IPR2020-01024, filed Jun. 3, 2020, Patent Owner Preliminary Response.
Petition for Inter Partes Review of U.S. Pat. No. 10,190,760, IPR2020-01024, filed Jun. 3, 2020, Declaration of Dr. Robert F. Karlicek in Support of Patent Owner's Preliminary Response.
Petition for Inter Partes Review of U.S. Pat. No. 10,190,760, IPR2020-01024, filed Jun. 3, 2020, Reply to Patent Owner's Preliminary Response.
Petition for Inter Partes Review of U.S. Pat. No. 10,190,760, IPR2020-01024, filed Jun. 3, 2020, Patent Owner Sur—Reply in Support of Patent Owner Preliminary Response.
Petition for Inter Partes Review of U.S. Pat. No. 10,190,760, IPR2020-01024, filed Jun. 3, 2020, Decision Granting Instituion of Inter Partes Review.
Petition for Inter Partes Review of U.S. Pat. No. 10,190,760, IPR2020-01024, filed Jun. 3, 2020, Scheduling Order.
Petition for Inter Partes Review of U.S. Pat. No. 10,190,760, IPR2020-01024, filed Jun. 3, 2020, Patent Owner's Objections under 37 CFR 42.64 to Petitioner's Evidence.
Petition for Inter Partes Review of U.S. Pat. No. 10,190,760, IPR2020-01024, filed Jun. 3, 2020, Patent Owner's Request for Rehearing.
Petition for Inter Partes Review of U.S. Pat. No. 10,190,760, IPR2020-01024, filed Jun. 3, 2020, Petitioner's Response to Patent Owner's Request for Rehearing.
Petition for Inter Partes Review of U.S. Pat. No. 10,190,760, IPR2020-01024, filed Jun. 3, 2020, Petitioner's Notice of Service of Supplemental Evidence.
Petition for Inter Partes Review of U.S. Pat. No. 10,190,760, IPR2020-01024, filed Jun. 3, 2020, Decision Denying Patent Owner's Request for Rehearing on Institution, Feb. 3, 2021.
Petition for Inter Partes Review of U.S. Pat. No. 10,190,760, IPR2020-01024, filed Jun. 3, 2020, Notice of Joint Stipulation to Modify Dates 1-3, Feb. 24, 2021.
United States District Court for the Eastern District of New York Central Islip Division, Case 2:19-cv-06268-MKB-ST, Defendant's Local Patent Rule 7 Invalidity Contentions.
Petition for Inter Partes Review of U.S. Pat. No. 9,909,748, IPR2020-01023, filed Jun. 3, 2020.
Petition for Inter Partes Review of U.S. Pat. No. 9,909,748, IPR2020-01023, filed Jun. 3, 2020, Exhibit 1003, Declaration of Eric Bretschneider.
Petition for Inter Partes Review of U.S. Pat. No. 10,190,760, IPR2020-01024, filed Jun. 3, 2020.
Petition for Inter Partes Review of U.S. Pat. No. 10,190,760, IPR2020-01024, filed Jun. 3, 2020, Exhibit 1003, Declaration of Eric Bretschneider.
Petition for Inter Partes Review of U.S. Pat. No. 9,909,748, IPR2020-01023, filed Jun. 3, 2020, Document 050, Patent Owner Response.
Petition for Inter Partes Review of U.S. Pat. No. 9,909,748, IPR2020-01023, filed Jun. 3, 2020, Document 051, Exhibit 2021, Deposition of Eric Bretschneider, Ph. D.
Petition for Inter Partes Review of U.S. Pat. No. 9,909,748, IPR2020-01023, filed Jun. 3, 2020, Document 052, Exhibit 2022, Second Declaration of Dr. Robert F. Karlicek.
Petition for Inter Partes Review of U.S. Pat. No. 9,909,748, IPR2020-01023, filed Jun. 3, 2020, Document 053, Petitioner's Objections to Evidence.
Petition for Inter Partes Review of U.S. Pat. No. 10,190,760, IPR2020-01024, filed Jun. 3, 2020, Document 051, Patent Owner's Response.

(56) References Cited

OTHER PUBLICATIONS

Petition for Inter Partes Review of U.S. Pat. No. 10,190,760, IPR2020-01024, filed Jun. 3, 2020, Document 053, Exhibit 2022, Second Declaration of Dr. Robert F. Karlicek.
Petition for Inter Partes Review of U.S. Pat. No. 10,190,760, IPR2020-01024, filed Jun. 3, 2020, Document 054, Petitioner's Objections to Evidence.
United States District Court for the Eastern District of New York Central Islip Division, Case 2:19-cv-06268-MKB-ST, Document 75, Defendant's Supplemental Claim Construction Brief Addressing Claim Constructions in IPR Institutions.
United States District Court for the Eastern District of New York Central Islip Division, Case 2:19-cv-06268-MKB-ST, Document 76, Plaintiff's Supplemental Claim Construction Brief.

* cited by examiner

LED LIGHT FIXTURE FOR USE IN PUBLIC TRANSPORTATION FACILITIES

CROSS-REFERENCE TO RELATED APPLICATIONS

This application is a continuation application claiming priority to U.S. patent application Ser. No. 17/153,523 filed Jan. 20, 2021, which is a continuation application claiming priority to U.S. patent application Ser. No. 15/886,406 filed Feb. 1, 2018, U.S. Pat. No. 10,941,929 issued Mar. 9, 2021, which is a divisional application claiming priority to U.S. patent application Ser. No. 14/703,705 filed May 4, 2015, U.S. Pat. No. 9,909,748 issued Mar. 6, 2018, which claims the benefit of U.S. Provisional patent application No. 61/988,032 filed May 2, 2014; the disclosures of each are incorporated herein by reference.

BACKGROUND OF THE DISCLOSURE

1. Technical Field

The disclosure relates to electric light fixtures and, more particularly, to electric light fixtures using light emitting diodes (LEDs) and having a plurality of power input options. The disclosure particularly relates to LED light fixtures configured for use in public transportation facilities where lighting failures are more critical than other facilities and wherein maintenance time and costs must be minimized. The disclosure also relates to light fixtures usable in public facilities which provide a plurality of power input options and wherein the normal-use light fixture may be used as part of an emergency lighting system drawing power from a battery backup system.

2. Background Information

Essentially all commercial and public buildings and facilities are required by applicable safety codes to have emergency lighting systems that operate during failures of normal utility power supplies. In the past, the emergency lighting systems used lighting sources separate from the normal lighting and each system had independent wiring runs, installation locations, and housings. Newer devices use a single lighting source for both systems. Applicable safety codes dictate the locations, brightnesses, operation, and testing of the emergency lighting systems. Periodic testing of such equipment is required and enforced by a government authority having jurisdiction over the facility.

Many high traffic areas of public transportation facilities are located underground and require light fixtures that operate 24 hours per day, seven days per week, fifty-two weeks per year. These light fixtures must be reliable, easy to replace when burned out, and must be energy efficient. Traditional lighting in public transportation facilities requires bulb changes and typically only provides for a single type of power input. Replacement light fixtures that are easier to maintain and more power efficient are desired by the owners and operators of these facilities. Light fixtures that provide installation flexibility are also desired because the fixtures are often being retrofit into an existing location.

SUMMARY OF THE DISCLOSURE

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

LED lighting systems, mounting configurations, and light fixtures are provided. Different configurations are disclosed for retrofit applications. Some configurations mount the light fixture with a mounting bracket that allows for the removal and replacement of the light fixture in about the same time as a traditional light bulb change. Some configurations provide for fuse removal and replacement without the need to dismount the light fixture from its mounting bracket or without the need to open the housing of the light fixture to access the fuses.

The disclosure also provides a light fixture with different power input options. The different power options provide installation flexibility. An option is to use multiple power inputs that back each other up if one fails. One disclosed feature is the use of multiple power inputs for the light fixtures to minimize downtime when one of the power sources fails. Up to four electrical inputs may be used with the power inputs being different voltages and different currents. The light fixture can be configured for a high voltage input such as a 600 Volt input power supply and connected to a 600 Volt input, a 110 Volt input and a battery backup power input at the same time. In the event of losing one source, the next takes over until the battery backup is reached.

Another disclosed feature is the use of a battery backup system with the LED light fixture wherein the light fixture and battery power sources encompass a compact package capable of being retrofit into the space of existing light fixtures that do not have the battery backup system. Another disclosed feature is a LED light fixture having desirable lumen distribution, power efficiency, quick maintenance, and a long life cycle.

The light fixture of the disclosure includes a configuration wherein both sides of the power source circuit is fused.

The light fixture of the disclosure provides a configuration having one or more fuses disposed within the enclosure. The fuses may be disposed in a sealed enclosure that also holds the LED power supply or the fuses can be sealed within their own enclosure. Sealed wire pass-through fittings are used for the wiring. The fuses are accessible from the outside of the enclosure so that they may be removed and changed without removing the light fixture from its mount. In one configuration, the fuses are carried in fuse holders that slide out to an exposed position in a movable drawer when the enclosure is opened. This configuration allows the fuses to be removed and replaced without opening the entire housing of the light fixture.

The preceding non-limiting aspects, as well as others, are more particularly described below. A more complete understanding of the processes and equipment can be obtained by reference to the accompanying drawings, which are not intended to indicate relative size and dimensions of the assemblies or components thereof. In those drawings and the description below, like numeric designations refer to components of like function. Specific terms used in that description are intended to refer only to the particular structure of the embodiments selected for illustration in the drawings, and are not intended to define or limit the scope of the disclosure

BRIEF DESCRIPTION OF THE DRAWINGS

Repeated reference numerals refer to similar parts of the disclosure.

DETAILED DESCRIPTION OF THE DISCLOSURE

The disclosure provides LED light fixtures 2 used as regular-duty light fixtures or as emergency light fixtures that provide light during an outage of normal line power. In some embodiments, light fixture 2 is used both as a regular-duty light fixture and then as an emergency light fixture during a power outage when the normal line power is not supplied to light fixture 2. Some embodiments of light fixture 2 include on-board battery backup systems while others are used with remote battery backup systems. Each light fixture 2 disclosed herein includes a LED-powered light engine that produces the light for fixture 2 and a LED power supply that accepts input electrical power and provides the needed output power specified for the LED light engine. The output power is normally a direct current, low voltage electrical supply. Sealed fuses also may be used between the input line power and the power supply and/or between the power supply and the LED light engine.

Light fixture 2 is configured for use in public transportation locations where high voltage electricity supplies are available. Each light fixture 2 disclosed herein is can be configuration accept and use the available high voltage electrical power. In one embodiment, the light fixture 2 is connected to both the high voltage input as well as a traditional 110-277 Volt line power. In some public transportation facilities, there are multiple 110-277 Volt power lines. Light fixture 2 can be configured to be connected to each of them for a redundant power input. When multiple 110-277 Volt power lines are available, alternating light fixtures 2 can be connected to alternating 110-277 Volt power lines. For example, the even numbered light fixtures 2 can be connected to a 600 Volt power source and a first 110-277 Volt power line and the odd numbered light fixtures can be connected to the 600 Volt power source and a second 110-277 Volt power line. Each light fixture 2 can then be connected to a remote or self-contained battery backup system. In another configuration, each light fixture 2 is provided with a power supply that connects to only a single electrical line power source but the light fixture is adapted to use different types of power supplies so the user can configure the light fixtures 2 for different power sources as desired. These light fixtures also may be connected to battery backup systems and used for emergency lighting situations.

Figure 3:
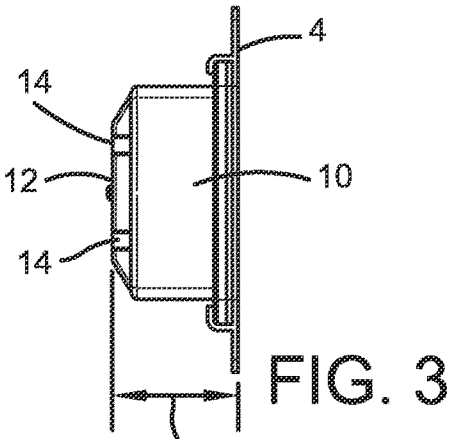
FIG. 3 is a right side view of the exemplary light fixture of FIG. 1.
Figure 1:
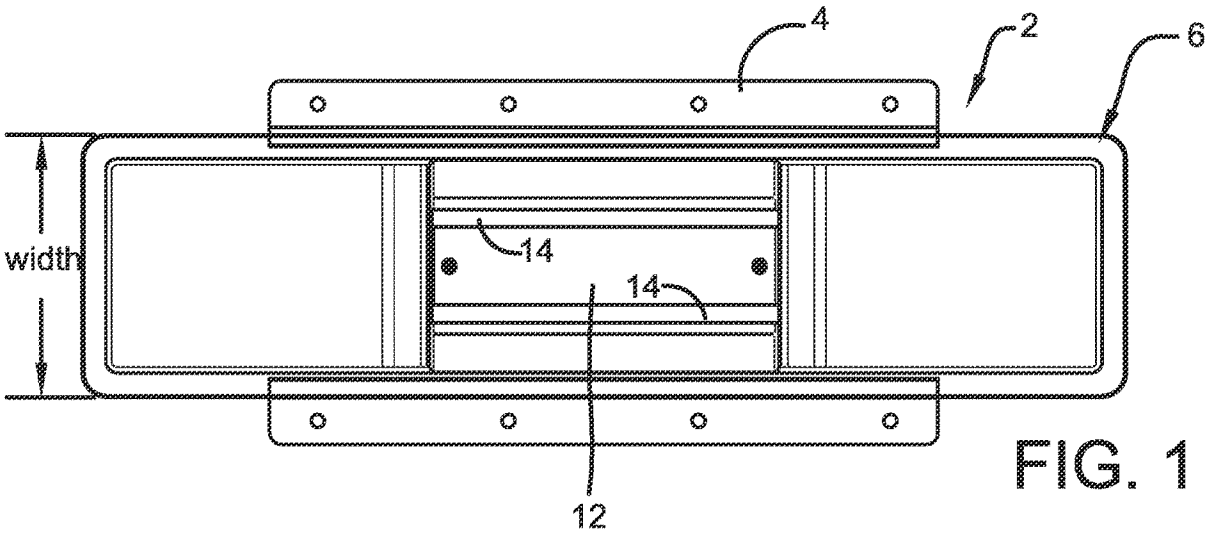
FIG. 1 is a front elevation view of an exemplary LED light fixture providing a first embodiment of the disclosure.
Figure 2:
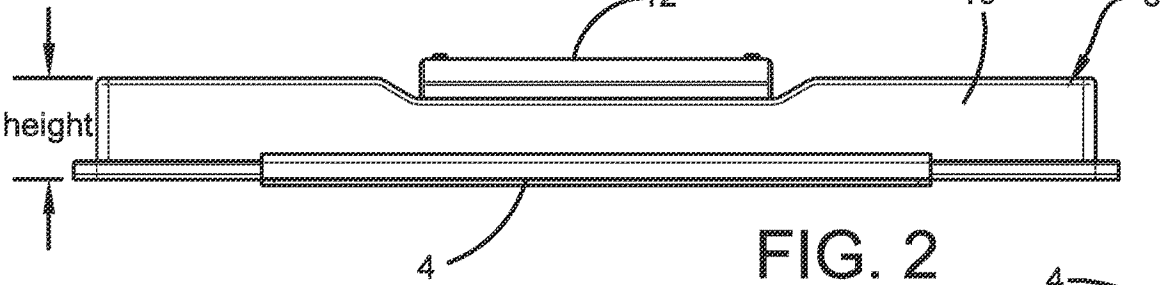
FIG. 2 is a bottom plan of the exemplary light fixture of FIG. 1.
Figure 4:
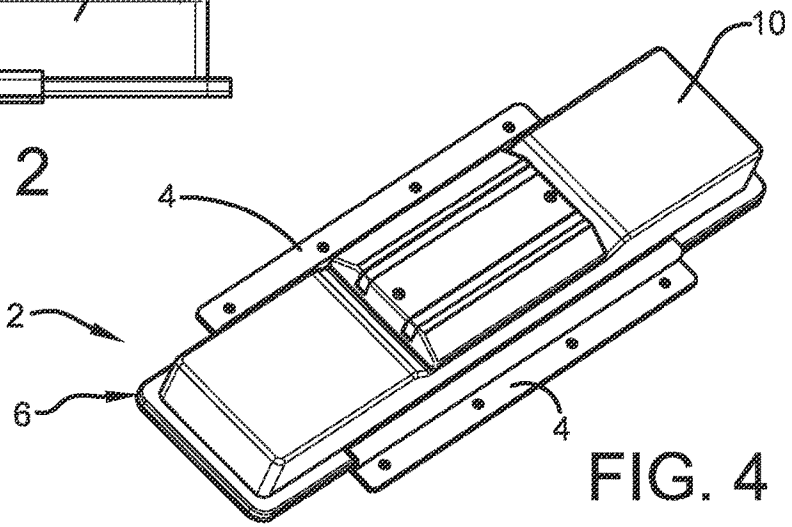
FIG. 4 is a perspective view of the exemplary light fixture of FIG. 1.

Light fixture 2 can be configured to have external dimensions to fit within existing wire ways of public transportation facilities to allow light fixtures 2 to replace existing light fixtures or into the same locations as existing emergency light fixtures. This allows for retrofitting into existing facilities with minimal disruptions. One configuration of light fixture 2 has an external height dimension (see FIGS. 2 and 3) of less than four inches (the exemplary configuration has a maximum height of 2.65 inches) so light fixture 2 may be used in ceiling locations. One configuration of the fixture provides both the light and the emergency battery system within the fixture enclosure. The fixture widths are shown in FIG. 1 with the maximum width being defined by the mounting flanges used to secure the fixture in a mounting bracket 4 that is used to secure the fixture to a structure. This fixture width is 7.625 inches or less.

Light fixture 2 includes a housing 6 that defines the mounting flanges 8 that are received by opposed overhanging fingers of mounting bracket 4. The overhanging fingers define channels that receive flanges 8. The connection between flange 8 and bracket 4 can be frictional, an interference fit, a snap fit, or one that may be secured with separate fasteners. Housing 6 includes at least one enclosure 10 that encloses components of fixture 2. Housing 6 also includes a mount 12 that supports the LEDs 14. Mount 12 may be fabricated from a material that allows it to function as a heat sink. Mount 12 may include fins to disperse heat from mount 12. In the exemplary configuration, light fixture 2 includes two spaced enclosures 10 and a pair of spaced LED circuit strips that each carry a plurality of LEDs 14. The LEDs 14 used with fixture 2 have a minimum combined illumination power to satisfy the emergency lighting requirements of the NFPA Life Safety Code. LEDs may be protected by a lens or a shield. The arrangement of the LEDs in elongated strips is useful for lighting an elongated path of recess. The lens used with fixture 2 can help distribute the LED light along the desired path.

When used in subway tunnels, mounting bracket 4 is directly connected to concrete walls with suitable anchors. Mounting bracket 4 can be made from stainless steel or galzanized steel. Housing 6 is made from stainless steel, galzanized steel, aluminum, polycarbonate, or a suitable polymer. When made from aluminum, direct contact between stainless steel and aluminum is undesirable especially in hot humid environments because of galvanic corrosion. A spacer may be used to prevent direct contact between the two metals while also providing a shock absorber against the repeated vibration forces to which fixture 2 is subjected. The spacer can be made from an insulating material such as a polymer, a rubber, fiberglass, PVC, or other insulating material.

Enclosure 10 may be substantially hollow to contain a variety of components used with fixture 2. In one exemplary configuration, batteries 20 and components of a self-testing battery backup system are carried within enclosure 10. A power supply 22 also may be carried within enclosure 10 to provide a self-contained fixture 2. In other configurations, the battery backup system and the power supply 22 can be located in locations remote from housing 6. The remote location can be a few feet away or farther such as other locations within the building or facility.

Fixture 2 includes a light engine that includes two rows of LED boards or strips 14 disposed above lenses designed to direct light downwardly from enclosure 10. Some light is directed through the ends of lenses to help define an elongated light pattern for the pathway. The LEDs meet at least the optical requirements of: end of life—0.25 foot candles across floor (14' width, 10' mounting height, 30' spacing on each side with 15' stagger)—0.55 lumen maintenance factor; Reflectivity of all surfaces=0.1; Color temperature: 4000K max; CRI: 70 min. The light engine is configured to at least match the light currently provided by the existing incandescent or florescent light bulbs if fixtures 2 are spaced the same. In one configuration with the spacing described above, the light provided on the ground is uniform both across and along the floor and has no more than a 7:1 ratio between the maximum lit areas and the minimum lit areas. When used as an emergency light fixture, light fixture 2 can be used to illuminate the paths of egress used during emergency situations. In emergency use, the LEDs are set to output at least one footcandle.

Light fixture 2 includes at least the light engine and power supply 22. When used as part of an emergency lighting system, light fixture 2 is selectively supplied by a backup power source which is typically one or more batteries 20. Batteries 20 are maintained by a self-testing emergency battery system having a variety of testing and reporting components including a battery charger 24.

Light fixture 2 is configured to be supplied by one of three line power sources in addition to the backup battery power source. In public transportation facilities, electrical power is available from the main power line 30 which is typically 110V to 277V alternating current. A second source of 110V to 277V alternating current is often provided from a secondary power source 32. A third high voltage source of electrical power greater than 277V is the high voltage "third rail" power source 34 from which train engines draw power. The third source 34 can be 450V-1000V direct current or commonly about 600V. Power supply 22 for the LED light fixture 2 includes power inputs for each of these three power sources 30, 32, 34 such that any of the three sources can be connected or a combination or all of the sources can be connected to allow whichever source is available. A switch is used to allow the user to manually select a power supply or to cause the power supply to automatically switch over to an available power supply in the event of a failure of another. For example, if the light fixture is being powered by the 600 Volt power supply and there is a failure of that power source, the power supply recognizes the voltage drop and automatically switches to the first of the 110-277 Volt power sources. If the first is not available, the power supply looks for the second 110-277 Volt power source. If all three of these power sources are not available, the power supply switches over to the available battery backup power.

If the location of fixture 2 has all three power supplies available, all three power supplies are connected to power supply 22. The 110-277V inputs are kept isolated from the 450-1000 Volt source. In one configuration, the power supply primarily uses the 110-277V input to provide the electrical power for power supply 22 that supplies the LEDs. If one of the 110-277 Volt inputs is not present, the power supply switches over to the second 110-277 Volt power source and then to the 450-1000 Volt source (typically 600V) to provide the electrical power for power supply 22 that provides the direct current to the LEDs. Different methods can be used to determine if the 110-277V inputs are present such as a relay, a voltage comparator, a microprocessor etc. In the case of a complete power failure, power supply 22 is supplied by batteries 20. This arrangement minimizes lighting outages.

The multiple power inputs for power supply 22 provide for a lighting arrangement where alternating fixtures 2 are connected to alternating power sources. In a corridor having twenty lights, half of them may be connected to first 30 and third 34 power supplies with the other half of fixtures 2 being connected to second 32 and third 34 power supplies. This arrangement shields half of the lights from issues with the normal line power supplies.

The LED power supply 22 converts the high voltage input voltage provided by the third rail 34, typically a 450-1000 VDC voltage, into a lower direct current voltage suitable for powering the LEDs 14. The external high voltage input voltage includes all input voltages of 277 Volts and higher. Power supply 22 is preferably flexible enough to accommodate input voltages of between 110-1000 Volts. In addition, power supply 22 is resistant to voltage spikes of up to 3 kV. Power supply 22 may be structured to accommodate a 480 Volt three phase supply voltage. Power supply 22 can provide polarity independence. Power supply 22 can include a rectifier circuit connected to the external high voltage input voltage. The rectifier circuit provides polarity independence. In one embodiment, the rectifier circuit is a full bridge rectifier, however, any suitable rectifier circuit may be used. An EMI filter circuit is provided to minimize electromagnetic interference (EMI). The filter circuit is positioned at an output of the rectifier circuit, but may alternatively be positioned at an input to the rectifier circuit. In this case, the EMI filter also provides transient protection. The filter circuit preferably includes capacitive and inductive components commonly used in filters. A converter circuit is connected to an output of the EMI filter circuit and converts the rectified high voltage input voltage into a lower voltage suitable for use in driving the LED circuits to produce light. In one embodiment, the converter circuit is a transformer, however, any suitable voltage converter circuit may be used. The driving voltage provided by the converter circuit is used to drive LEDs 14. This drive voltage is preferably provided in a relatively constant manner.

In one embodiment, the drive voltage output from the filter circuit is provided to one of several current control circuits which are, in turn, connected to the LED strips 14. That is, a separate current control circuit is provided for each LED strip 14 in the light fixture 2. The current control circuit receives the smooth driving voltage from the filter circuit and provides a driving current to the LEDs. If additional, or fewer, light engines are included in the fixture 2, additional or fewer current control circuits may be used. In one exemplary embodiment, the current control circuit is integral with the printed circuit board of each LED strip 14. Alternatively, they may be incorporated into power supply 22 and power supply 22 may include separate outputs for each light engine to which it is connected.

In one configuration, battery charger 24 is powered from one of power sources 30, 32, or with third rail high voltage source 34. The voltage/current derived for charging the battery is a separate channel output from either 110-277 Volt input circuit 30,32 or the 450-1000 Volt input circuit 34 depending on which is preferable in the application.

In another configuration, power supply 22 has an output power supply line 36 for the battery charger 24 that is used to maintain the charge in batteries 30 of the battery backup power source. Batteries 20 supply DC electricity at a voltage as required for use with the LED circuit. Batteries 20 are configured to power the LED circuit for a minimum of ninety minutes and up to four hours. Batteries may be wired to power supply 22 or directly to LEDs 14.

Figure 5:
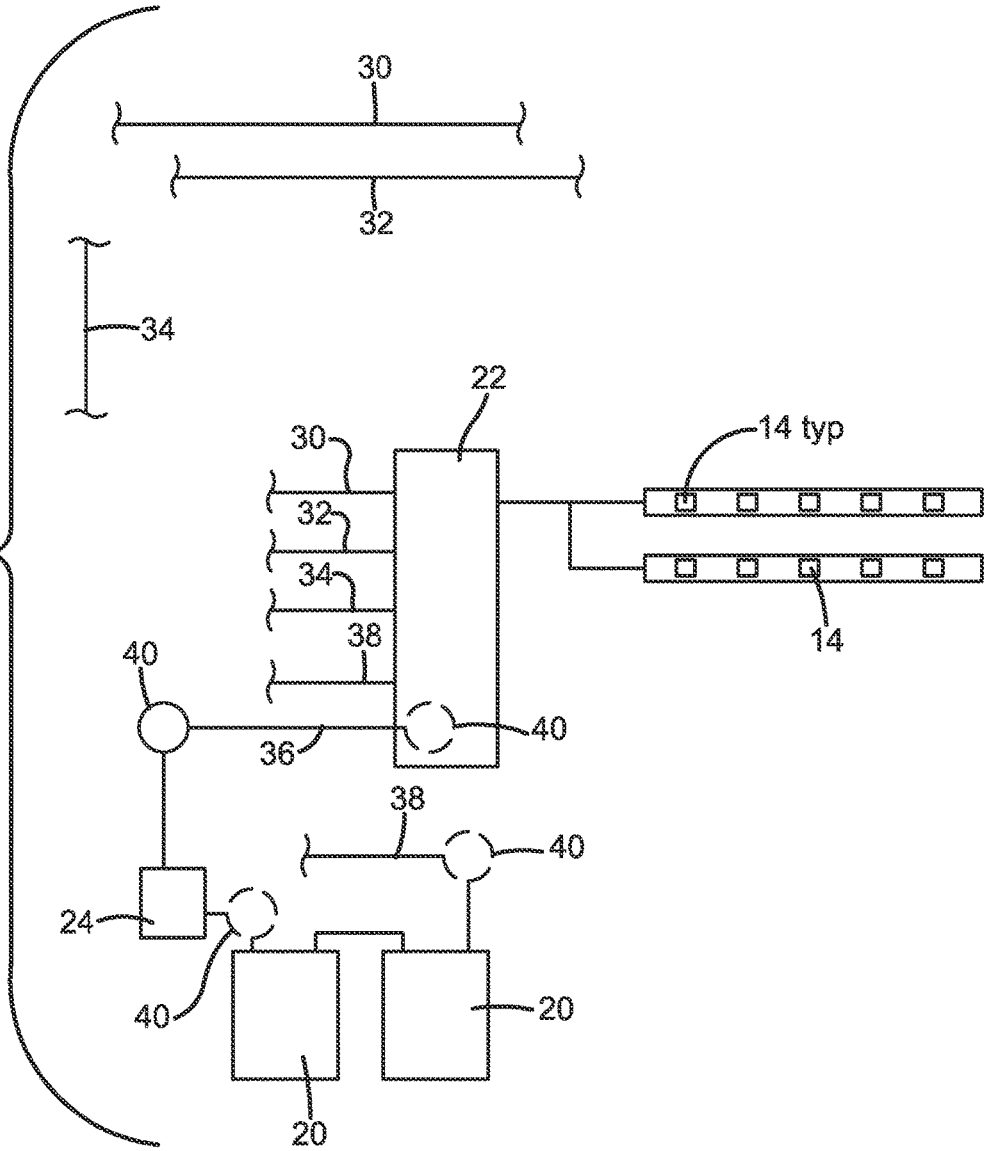
FIG. 5 is a schematic view showing the different power sources that can be used to provide electrical power to the different embodiments of the disclosed light fixtures.
Figure 6:
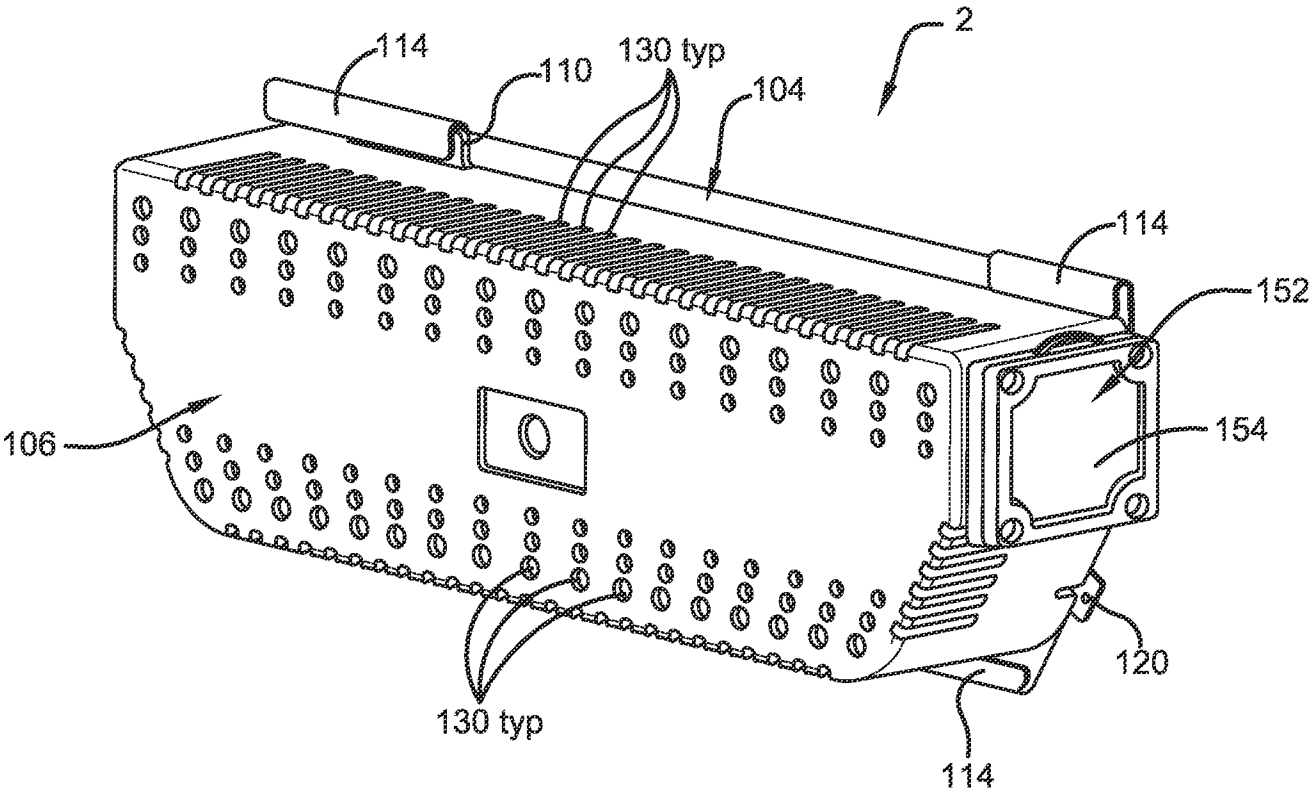
FIG. 6 is a front right perspective view of an exemplary LED light fixture providing a second embodiment of the disclosure.
Figure 7:
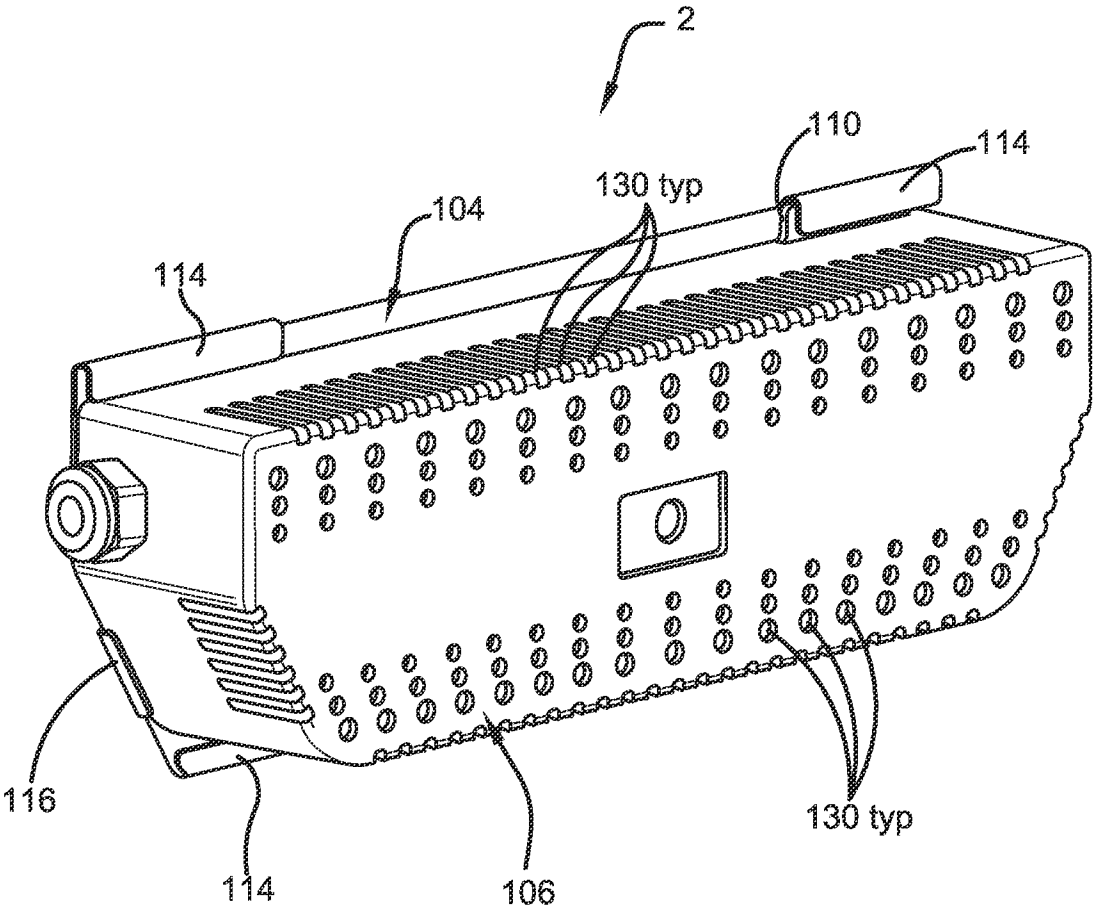
FIG. 7 is a front left perspective view of the LED light fixture of FIG. 6.

Battery charger 24 is used to maintain batteries 20 in fully charged conditions so they are ready for emergency use at any time. Battery charger 24 can be powered by any one of the three sources of electric power described above through a supply 36. During a power outage, battery power is supplied to power supply 22 through connection 38 which is controlled by switch 40. Under normal conditions, switch 40 allows batteries 20 to be charged by battery charger 24. Switch 40 may be located in a variety of positions and arrangements with respect to power supply 22 and battery charger 24 with the position depicted in FIG. 5 being exemplary. Battery charger 24 may be an integral component of power supply 22 or a separate component. In one configuration, battery charger 24 is powered by the high voltage third power source 34. Battery charger 24 can have a power input of 600V to allow this high voltage power source 34 to be used to charge batteries 20. The power from high voltage power source 34 is stepped down to a DC voltage that is used to charge battery 20. It may be the same DC voltage of the battery or slightly higher than the DC voltage of the battery depending on the chemistry of the battery. A trickle charging circuit is used to prevent overcharging of the battery. Typically a constant voltage is applied for charging the battery. Depending on the chemistry of the battery the current can either be a constant low current or the system can charge by pulsing between a low current to a higher current. Battery charger 24 can be a trickle-style charger that maintains a low current direct voltage through batteries 20. Battery charger 24 can thus remain connected to batteries 20 indefinitely. In some locations and applications, the third rail high voltage source 34 is less likely to fail than the first 30 and second 32 power sources and thus provides more reliability to the system. In other locations and applications, the 110-277V power sources may be less likely to fail. In those instances the 110-277V power source would be used to charge the battery. The power supply may include a circuit that allows it to charge batteries 20 from with the either 110-277V input 30, 32 or the 450-1000V input 34.

Power supply 22 can be optionally configured to pass MIL-STD-461F testing. Power supply 22 can be physically located at a separate location from the LEDs and power supply 22 can be physically located at a separate location from batteries 8.

Each battery backup system is periodically monitored for proper function and the results of the monitoring can be displayed locally and/or delivered as data to a remote location. The testing function can be triggered manually by way of push button manually pushed by a user, through the use of a RF trigger signal transmitted from a hand-held RF transmitter, or a magnetic switch that senses a magnetic field brought into close proximity with the switch. Such a magnetic field may be created with a magnetic that is moved into close proximity to the switch by a worker. The magnet can be hand-held or mounted to a wand that allows the worker to reach the light fixture 2. The switch can be a mechanical or electrical magnetic field sensing switch. A battery monitoring and emergency power testing circuit can be used to provide the self-testing monitoring function. Testing requirements typically include battery charge, battery discharge, the operation of the transfer switch, and the operation of the lights. The local display may be an indicator light or multiple indicator lights associated with each light fixture 2. The state of the indicator light provides information about the status of the system. For example, the indicator light may be lit continuously to indicate proper function, it may slow blink to indicate a malfunction, it may be off to indicate a malfunction, and it may flash quickly to indicate light fixture 2 is operating on battery power. Different indicator lights or light conditions can be used to indicate which power source is being used to provide power to power supply 22. For example, a red indicator light can be used to indicate that the 277 V input power is being used while a green indicator light can be used to indicate that the 600 V input power is being used. Both may be turned on to indicate battery power.

Data relevant to the monitoring of the battery backup system can be delivered to the manager of the facility, to the authority having jurisdiction over the lighting tests, to a remote computer, or to a website through an Ethernet cable, a Power Line Communication protocol, or any of a variety of wireless communications protocols including WIFI or ZigBee. A RuBee (IEEE standard 1902.1) communications protocol may be used for the relatively harsh environments faced by wireless communications systems in underground transportation facilities. In order to communicate the data, each fixture can include a communications device that provides for the desired communications. For example, each fixture 2 can include a Wifi chip, a ZigBee chip, or a RuBee transceiver. The remote computer can be a computer located in the same facility as the light fixture 2 providing the reporting or a computer located in a location remote from the facility. The data may be available through the Internet through a web server. The data communicated to the remote location may include information about malfunctions, battery levels, lumen output of LEDs, status of power supply, the identification of which power source is being used, and the physical location of the item having a malfunction so that it can be repaired. A service message can be generated and communicated by text, email, phone, or other communications methods to service personnel.

Each light fixture 2 also can include a sensor or communications chip that functions as an air sensor that provides data through the above communications protocol. Each light fixture 2 can include a camera that provides data through the above communications protocol. At the same time, each fixture can include an alarm light or speaker that is triggered by the communications system described above.

Light fixture 2 described above having the plurality of power inputs can be retrofit into existing light fixtures to provide updated efficient lighting functions. For example, a fluorescent light fixture having one or a plurality of fluorescent bulbs may be retrofit by removing the bulbs and ballast and installing the LEDs and power supply within or associated with the existing fluorescent housing. In these situations, the LEDs can be provided in the form of a flat panel LED that fits within the existing fixture. In one configuration, a fluorescent fixture has a U-shaped bulb disposed at one end of a housing and can accept a power input such as 30 and 34 described above. The components of light fixture 2 may be retrofit into such a housing to provide a LED light fixture that is on during normal use, an emergency light fixture, or a combination of both.

FIGS. 6-14 disclose additional embodiments of a light fixture which are indicated generally by the numeral 102. This embodiment may be configured to retrofit into the spaces described above or can be configured to have a height of 3.7 inches or less, a width of 6.4 inches or less, and a length of 17.4 inches or less. Fixture 102 includes at least the fixture housing 106 and electrical components needed to power LED light sources. Fixture 102 also may include the components of the mounting arrangement and/or a battery backup system and/or communications devices as described above.

Figure 13:
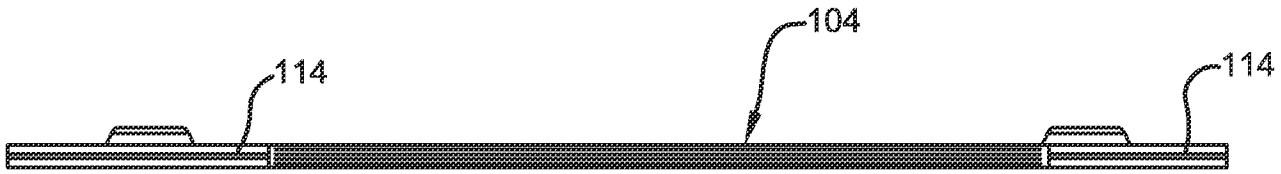
FIG. 13 is a top plan view of FIG. 12.
Figure 12:
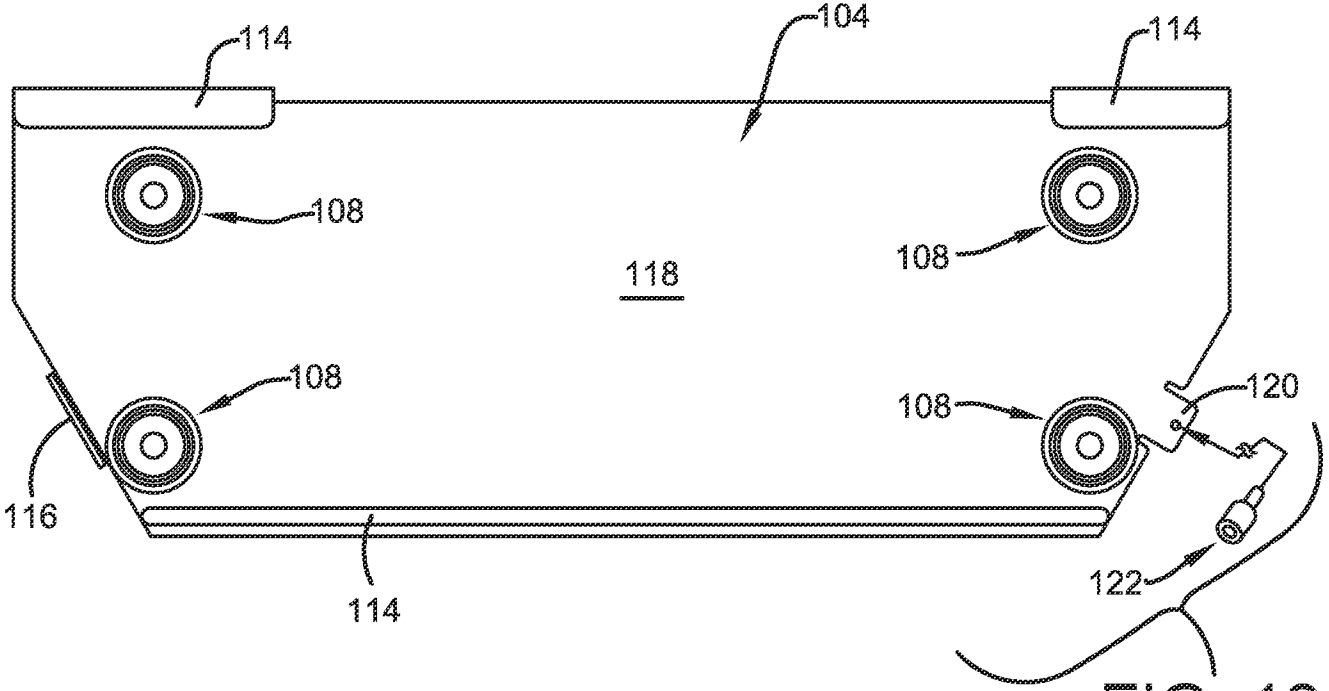
FIG. 12 is a front elevation view of the mounting bracket for the light fixture housing.
Figure 14:
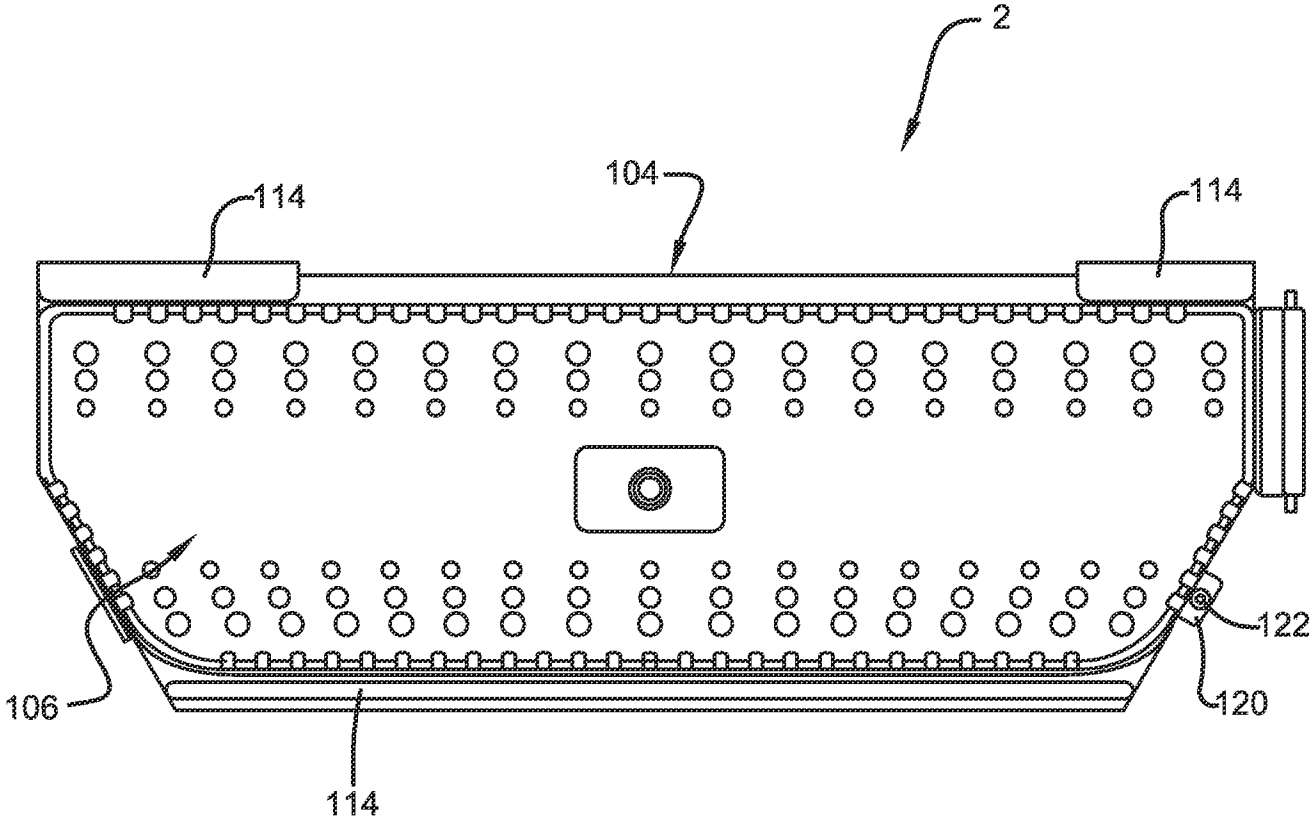
FIG. 14 is a front elevation view of the light fixture supported by the light fixture bracket of FIG. 12.

A mounting bracket 104 shown in FIGS. 12 and 13 allows light fixture housing 106 to be quickly mounted and dismounted for its desired location. The mounting connection can be friction, a snap fit, a connector, or a combination of these. As described above, mounting bracket 104 is often directly connected to concrete walls with suitable anchors disposed at anchor locations 108 shown in FIG. 12. Mounting bracket 104 can be made from stainless steel. Light fixture housing 106 can be made from steel, stainless steel, galzanized steel, aluminum, polycarbonate, or a different polymer. When made from aluminum, direct contact between stainless steel and aluminum is undesirable especially in hot humid environments because of galvanic corrosion. A spacer (not shown) may be used to prevent direct contact between the two metals while also providing a shock absorber against the repeated vibration forces to which fixture 2 is subjected. The spacer can be made from an insulating material such as a polymer, a rubber, fiberglass, PVC, or other insulating material.

Light fixture housing 106 includes spaced upper mounting tabs 110 and a lower mounting tab 112 that slide into channels 114 defined by mounting bracket 104. A stop 116 projects forwardly from the rear wall 118 of mounting bracket 104 to stop light fixture housing 106 from sliding all the way through mounting bracket 104. A lock tab 120 supports a removable second stop 122 which may be a threaded connector or a rubber knob supported by a threaded connector to lock light fixture housing 106 in between stop 116 and second stop 122.

Light fixture housing 106 defines a plurality of ventilation openings 130 that expose the inside of housing 106 to the environment surrounding light fixture 2. Although ventilation is desirable for the LED light engine 132, the water vapor and corrosive elements carried by humid air found in a public transportation facility is not desirable for the power supply 134 or for the fuses (when such fuses are used). LED light engine 132, power supply 134 and fuses (when used) are carried by housing 106 and all are removed from mounting bracket 104 when housing 106 is removed from mounting bracket 104.

Figure 9:
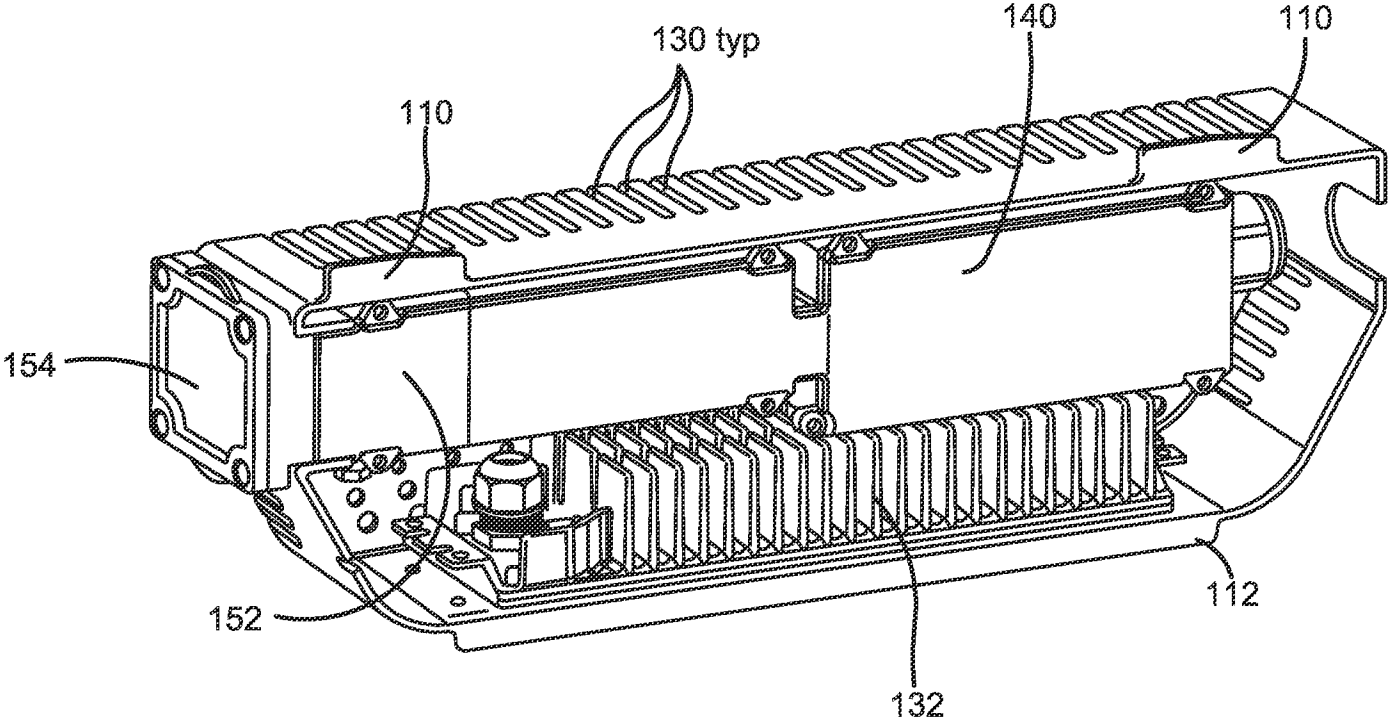
FIG. 9 is a rear view of the light fixture housing of FIG. 6 showing a sealed enclosure for the fuses and power supply.
Figure 10:
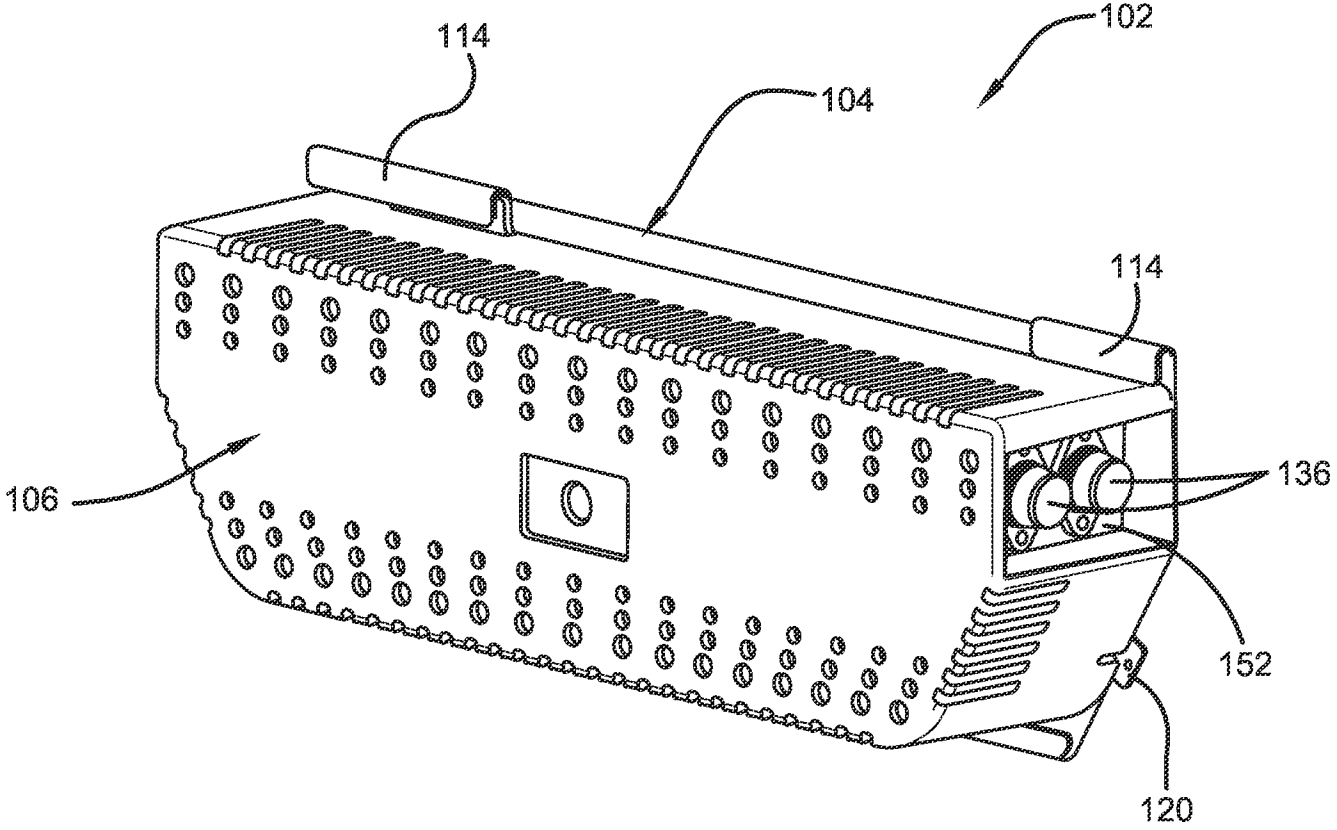
FIG. 10 is a view similar to FIG. 8 showing a different embodiment of the light fixture with the fuse cover removed to expose fuses.
Figure 11:
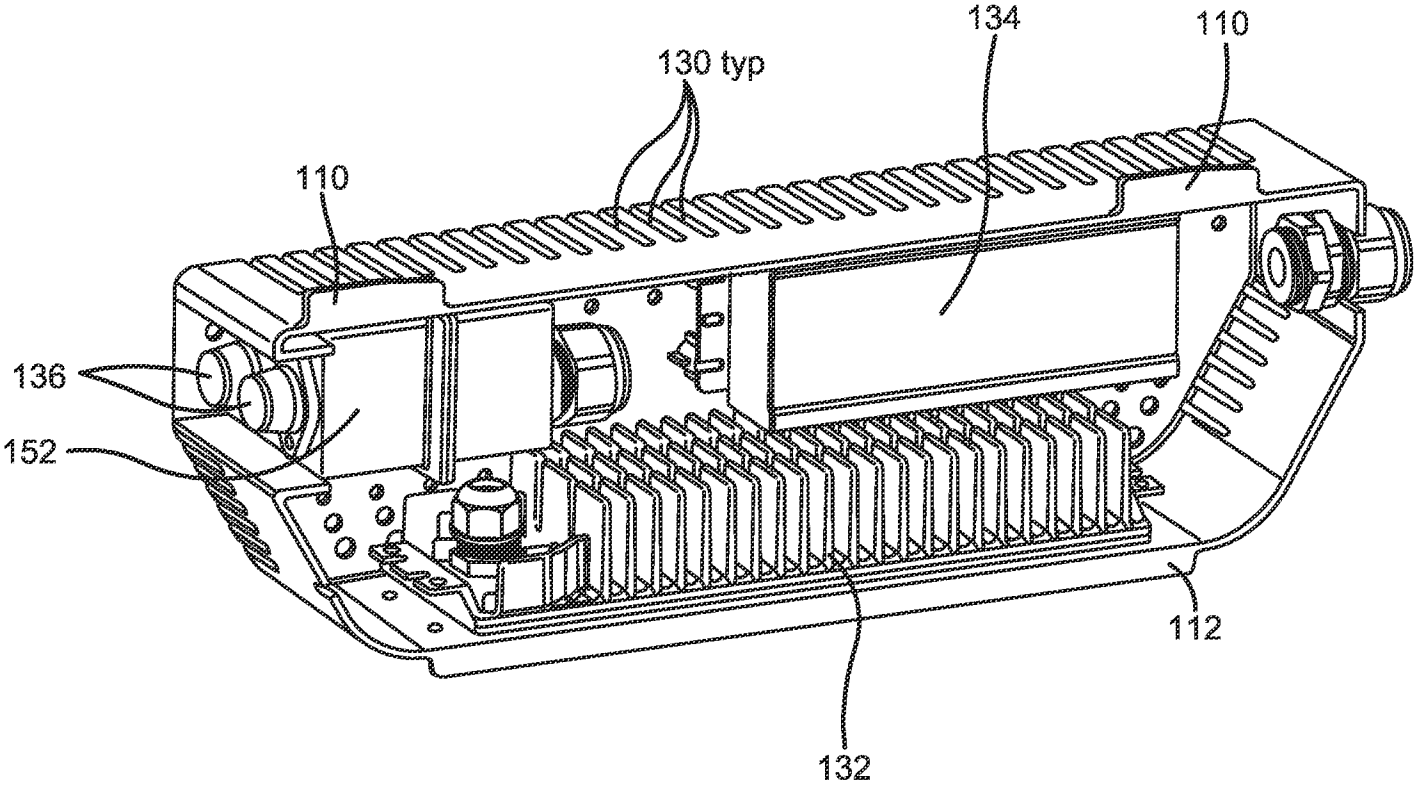
FIG. 11 is a view similar to FIG. 9 showing a sealed housing for the fuses of the FIG. 10 embodiment.

The LEDs that produce the light of fixture 2 are located at the bottom of fixture 2 and shine down through a protective lens that is designed to direct the light in a desired pattern. Heat sink fins project up from the LED circuits where they are allowed to vent with outside air through openings 130. Power supply 134 can be disposed (1) within a common sealed enclosure 140 that seals both the power supply 134 and any fuses from outside air and moisture vapor; (2) power supply 134 can be disposed within its own enclosure separate and independent from any fuse housing; or (3) power supply 134 can be disposed within housing 106 and exposed to the air within housing 106. FIG. 9 depicts a common enclosure 140. This enclosure provides a water-tight and moisture-vapor tight sealed housing for power supply 134 and a fuse or fuses for fixture 102.

Any of the above-described power input configurations and battery backup system configurations can be used with fixture 102. Alternatively, power supply 134 can be connected to a single source of input power 30, 32, or 34 or power from batteries 20 during an emergency. Batteries 20 and the backup battery system components can be located within housing 106 or remote from housing 106. Different power supplies for different input power sources can be fit within enclosure 106. Fixture 102 thus may be configured for 110V input or 600V input.

The fuses are used to protect power supply 134 or LED light engine components. When used to protect power supply 134, input power is directed to a first fuse prior to being delivered to the power supply 134 through a positive power connection. The neutral side of the power connection is also fused with a second fuse that is connected to the neutral side of the power supply 134 with a power connection. As such, each side of the input power source—both positive and neutral—is fused. Providing fuses on the neutral power line protects the user from any back feed through the neutral line. Providing fuses on both sides of the circuit protects the power supply and allows a worker to remove the fuses from both sides of the circuit for safety. This is particularly useful in a three phase 480 Volt system. When fuses are used after power supply 134, each side of the direct power loop and can fused (both supply and return lines).

Figure 8:
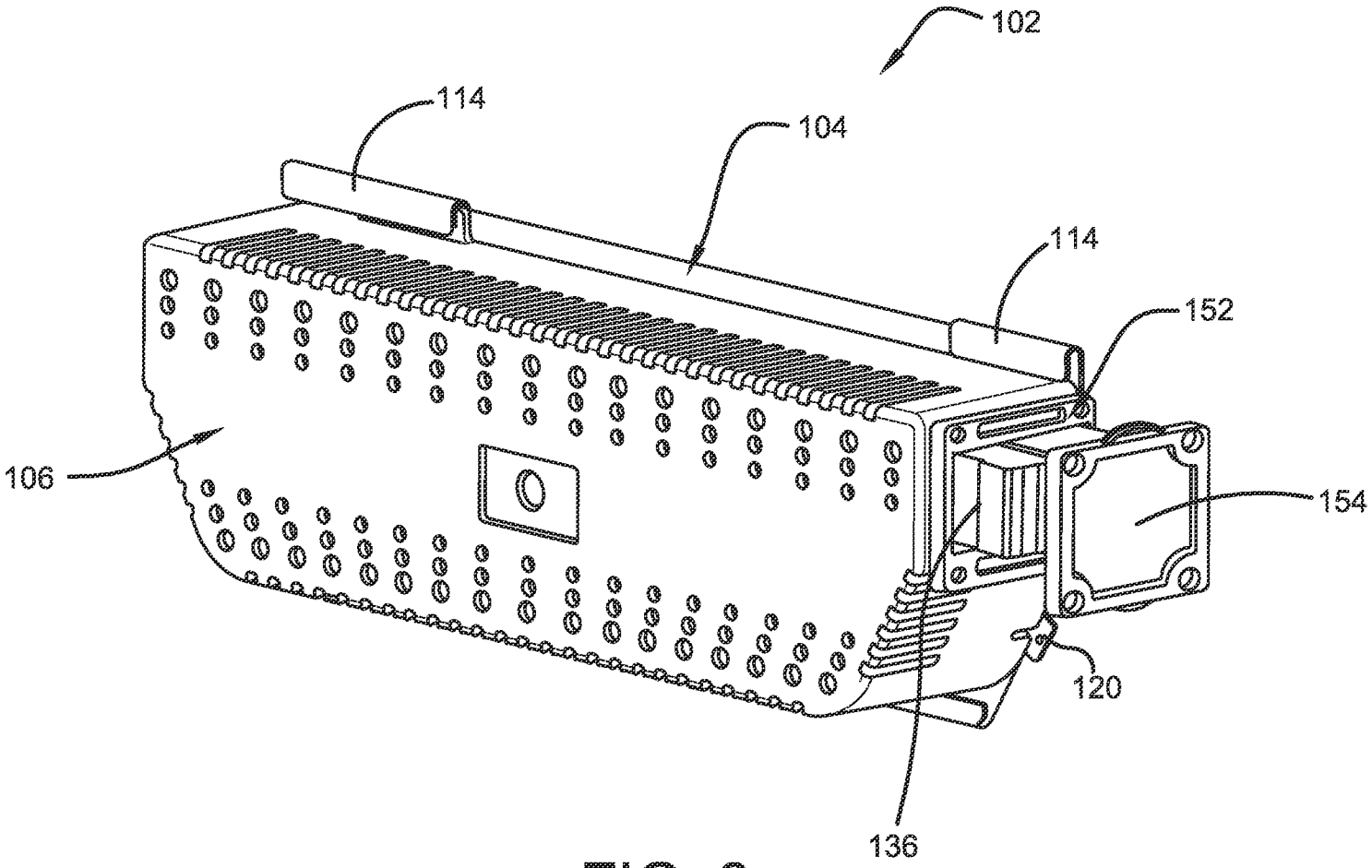
FIG. 8 is a view similar to FIG. 6 showing the fuse cover panel removed.

The fuses are carried by fuse holders 136 that are located in a sealed fuse housing 152. Sealed fuse housing 152 can be a stand-alone enclosure or an extension that is integral with power supply enclosure 140. Sealed fuse housing 152 is carried by housing 106 and can be disposed within housing 106 or outside of housing 106 but connected thereto. Fuse housing 152 can include a door 154 that allows the fuses to be accessed, removed, and replaced. Door 154 includes a gasket or seal that seals the door opening when door 154 is attached and closed. In the configuration of FIGS. 8-9, each fuse is held in a fuse holder 136 that slides out of housing 152 on a sliding drawer component of housing 152 to provide access to fuse 136. These styles of fuse holders are generally used for the higher voltage applications such as 600 Volt applications. In the FIG. 10-11 configuration, fuse holders 136 are directly accessible through the end of fixture 2 wherein they can be removed by unscrewing the end of the fuse holder 136 and removing the fuse from housing 152. These styles of fuse holders are generally used for the lower voltage applications. The FIG. 10-11 configuration can use a sealed door 154 and a sliding drawer as an option. In both of these configurations, both the hot power line and the neutral line or the power supply line and power return line can be fused.

The foregoing description has been made with reference to exemplary embodiments. Modifications and alterations of those embodiments will be apparent to one who reads and understands this general description. The present disclosure should be construed as including all such modifications and alterations insofar as they come within the scope of the appended claims or equivalents thereof.

The invention claimed is:

1. An LED light fixture comprising:

at least one fixture housing;

a plurality of LEDs, at least one of which is disposed within said at least one fixture housing for providing light;

at least one LED power supply coupled to at least one of said plurality of LEDs, said at least one LED power supply configured to power said at least one of said plurality of LEDs, and further configured to accept power from:

one or more standard voltage sources supplying AC voltage at or below 277V; and one or more transportation power sources supplying DC voltage between approximately 450V and 1000V to one or more public transportation vehicles; and a battery backup system coupled to at least one of said plurality of LEDs and said a least one LED power supply.

2. The LED light fixture of claim 1, wherein said one or more transportation power sources is a third rail within a public transportation facility.

3. The LED light fixture of claim 2, wherein said at least one LED power supply is resistant to voltage spikes of up to 3 kV DC.

4. The LED light fixture of claim 1, wherein said LED power supply is configured to accept power from two or more standard voltage sources supplying AC voltage at or below 277V.

5. The LED light fixture of claim 1, wherein said at least one LED disposed within said at least one fixture housing is selectively powered by said at least one LED power supply when at least one of said one or more standard voltage sources and said one or more transportation power sources are available.

6. The LED light fixture of claim 5, wherein said battery backup system selectively powers said at least one LED disposed within said at least one fixture housing when said one or more standard voltage sources and said one or more transportation power sources are not available.

7. The LED light fixture of claim 1, wherein said at least one LED disposed within said at least one fixture housing is powered by said battery backup system.

8. The LED fixture of claim 1, wherein said at least one LED power supply automatically switches between said power sources.

9. The LED light fixture of claim 1, wherein said at battery backup system is disposed within said at least one fixture housing.

10. The LED light fixture of claim 1, wherein said at least one LED power supply is disposed within said at least one fixture housing.

11. The LED light fixture of claim 1, wherein said at least one LED power supply and said battery backup system are disposed within said at least one fixture housing.

12. The LED light fixture of claim 1, further comprising a battery charger, said charger being powered by said LED power supply.

13. The LED light fixture of claim 1, wherein said at least one fixture housing is configured to fit within the wire way of a public transportation facility.

14. LED light fixture of claim 1, further comprising a mounting system configured to mount said at least one fixture housing to a public transportation facility, said mounting system comprising a mounting bracket and a shock-absorbing spacer configured to fit between said mounting bracket and said at least one fixture housing.

15. A light fixture comprising:

a fixture housing;

a plurality of LEDs carried by the fixture housing for providing light from the fixture housing;

an LED power supply having a first power input connected to a standard voltage power source supplying a standard power of 110V-277V, and a second power input adapted to draw a high power greater than the standard power from a rail from which a train engine draws power, wherein the LED power supply is adapted to automatically switch between the first power input and the second power input to supply power to the plurality of LEDs; and a battery backup system selectively powering the LEDs when the standard voltage power source cannot supply the standard power and the second power input does not receive the high power.

16. The system of claim 15, wherein the LED power supply is carried within the fixture housing.

17. The system of claim 15, wherein the LED power supply is disposed remote from the fixture housing.

18. The system of claim 15, wherein the battery backup system is carried by the fixture housing.

19. An LED light fixture comprising:

at least one fixture housing;

a plurality of LEDs associated with said at least one fixture housing for providing light;

at least one LED power supply coupled to at least one of said plurality of LEDs, said at least one LED power supply configured to power said at least one of said plurality of LEDs, and further configured to accept power from:

one or more standard voltage sources supplying AC voltage at or below 277V; and one or more transportation power sources supplying DC voltage between approximately 450V and 1000V to one or more public transportation vehicles; said one or more transportation power sources being a third rail within a public transportation facility;

wherein said at least one LED power supply automatically switches between said power sources;

a battery backup system coupled to at least one of said plurality of LEDs and said a least one LED power supply.

20. The LED light fixture of claim 19, wherein said at least one LED power supply is resistant to voltage spikes of up to 3 kV DC.

21. The LED light fixture of claim 19, wherein said LED power supply is configured to accept power from two or more standard voltage sources supplying AC voltage at or below 277V.

22. The LED light fixture of claim 19, wherein said plurality of LEDs are selectively powered by said at least one LED power supply when at least one of said one or more standard voltage sources and said one or more transportation power sources are available.

23. The LED light fixture of claim 22, wherein said battery backup system selectively powers said plurality of LEDs when said one or more standard voltage sources and said one or more transportation power sources are not available.

24. The LED light fixture of claim 19, wherein said at battery backup system is disposed within said at least one fixture housing.

25. The LED light fixture of claim 19, wherein said at least one LED power supply is disposed within said at least one fixture housing.

26. The LED light fixture of claim 19, wherein said at least one LED power supply and said battery backup system are disposed within said at least one fixture housing.

27. The LED light fixture of claim 19, further comprising a battery charger, said charger being powered by said LED power supply.

28. The LED light fixture of claim 19, wherein said at least one fixture housing is configured to fit within the wire way of a public transportation facility.

29. LED light fixture of claim 19, further comprising a mounting system configured to mount said at least one fixture housing to a public transportation facility, said mounting system comprising a mounting bracket and a shock-absorbing spacer configured to fit between said mounting bracket and said at least one fixture housing.

* * * * *